US008807379B1

(12) United States Patent
Hammond

(10) Patent No.: US 8,807,379 B1
(45) Date of Patent: Aug. 19, 2014

(54) INTEGRATED GARBAGE CAN AND GARBAGE BAG DISPENSER

(76) Inventor: Alicia Hammond, Gulf Shores, AL (US)

( * ) Notice: Subject to any disclaimer, the term of this patent is extended or adjusted under 35 U.S.C. 154(b) by 33 days.

(21) Appl. No.: 13/186,210

(22) Filed: Jul. 19, 2011

(51) Int. Cl.
*B65D 25/14* (2006.01)

(52) U.S. Cl.
USPC ..... 220/495.07

(58) Field of Classification Search
USPC ..... 220/495.07, 495.05
See application file for complete search history.

(56) References Cited

U.S. PATENT DOCUMENTS 3,451,453 A * 6/1969 Heck ..... 206/390
4,349,123 A 9/1982 Yang
4,364,490 A * 12/1982 Lang et al. ..... 220/495.07
4,721,276 A * 1/1988 Moss ..... 248/311.2
4,850,507 A 7/1989 Lemongelli et al.
4,955,505 A 9/1990 Battaglia
5,031,793 A * 7/1991 Chen et al. ..... 220/495.07
5,115,935 A * 5/1992 Lemongelli ..... 220/495.07
5,295,607 A * 3/1994 Chang ..... 220/495.07
5,628,424 A 5/1997 Gola
5,632,401 A * 5/1997 Hurd ..... 220/495.07
5,678,723 A * 10/1997 Swift et al. ..... 220/495.07
5,690,247 A 11/1997 Boover
5,738,239 A * 4/1998 Triglia ..... 220/495.07
5,803,303 A 9/1998 Timm et al.
6,126,031 A * 10/2000 Reason ..... 220/495.07
6,520,371 B2 * 2/2003 Cheng ..... 221/33
6,568,555 B1 * 5/2003 LoCascio ..... 220/495.07
7,490,733 B2 * 2/2009 Tagliareni ..... 221/46

* cited by examiner

*Primary Examiner* — Timothy Waggoner
(74) *Attorney, Agent, or Firm* — Maynard, Cooper & Gale, P.C.; Jon E. Holland

(57) ABSTRACT

Embodiments of the present disclosure generally pertain to garbage cans. An integrated garbage can and garbage bag dispenser in accordance with an exemplary embodiment of the present disclosure comprises a container having a floor, walls and an open top. A portion of the floor is elevated and has an opening for receiving garbage bags. A lip of the opening slopes down from the opening to a generally horizontal, flat surface of the elevated floor. A drawer extends from a wall of the garbage can near the bottom of the garbage can, and the drawer receives a garbage bag dispenser containing a plurality of garbage bags. When the drawer contains the garbage bag dispenser and is in a closed position, the drawer is positioned below the elevated floor and the bags of the dispenser align with the opening such that the bags may extend up into the container through the floor via the opening. Furthermore, the garbage can is weighted such that removal of a full garbage bag from the can or a new garbage bag from the dispenser will not likely lift the can from the ground.

21 Claims, 6 Drawing Sheets

INTEGRATED GARBAGE CAN AND GARBAGE BAG DISPENSER

RELATED ART

Garbage cans for storing trash are typically lightweight and lined with a disposable garbage bag for disposing of the trash when the garbage can is full. The garbage bag is typically made of a flexible, lightweight material, such as, for example, plastic. As the garbage bag is filled with trash, the garbage bag expands such that an outer surface of the bag hugs an inner surface of the garbage can. When the garbage bag is full, removal of the garbage bag from the garbage can often become difficult due to the bag being wedged within the can. For example, the can may be lifted from the ground as the user attempts to remove the bag from the can. Accordingly, a user might attempt to remove the bag with one hand while holding the can down with the other hand. Such method of removal is problematic, particularly when the bag is heavy due to a large amount of trash within the bag.

Furthermore, storage of a garbage bag dispenser in a separate location from the garbage can consumes storage space which is often limited. Users often store a few new, unused garbage bags in the bottom of the garbage can container for easy access when the full garbage bag is removed. However, such storage of the new garbage bags often results in contamination of the bags when the contents of the full garbage bag inadvertently spill or seep into the garbage can. Such contamination is inconvenient and can become costly.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Embodiments of the present disclosure generally pertain to garbage cans. An integrated garbage can and garbage bag dispenser in accordance with an exemplary embodiment of the present disclosure comprises a container having a floor, walls and an open top. A portion of the floor is elevated and has an opening for receiving garbage bags. A lip of the opening slopes down from the opening to a generally horizontal, flat surface of the elevated floor. A drawer extends from a wall of the garbage can near the bottom of the garbage can, and the drawer receives a garbage bag dispenser containing a plurality of garbage bags. When the drawer contains the garbage bag dispenser and is in a closed position, the drawer is positioned below the elevated floor and the bags of the dispenser align with the opening such that the bags may extend up into the container through the floor via the opening. Furthermore, the garbage can is weighted such that removal of a full garbage bag from the can or a new garbage bag from the dispenser will not likely lift the can from the ground.

Figure 1:
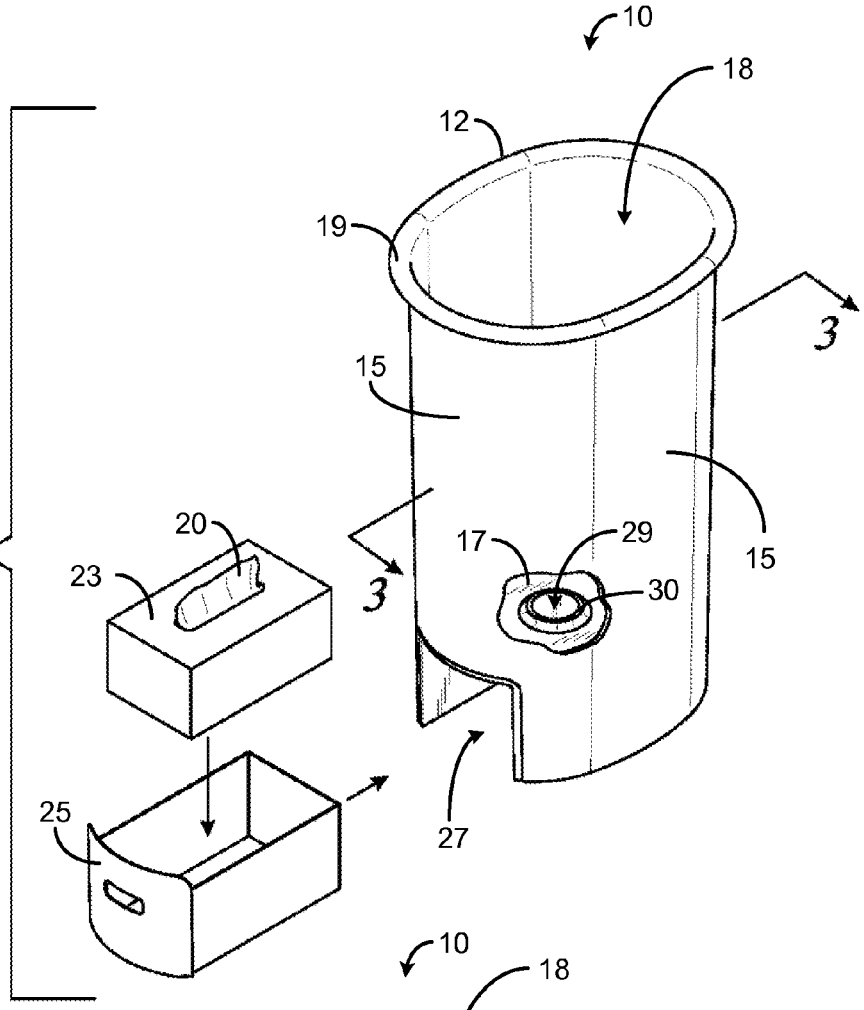
FIG. 1 is a top perspective view of an exemplary integrated garbage can and garbage bag dispenser in accordance with the present disclosure.

FIG. 1 depicts a top perspective view of an exemplary integrated garbage can and garbage bag dispenser 10. The integrated garbage can 10 comprises a container 12 having at least one exterior wall 15, a floor 17, and an upper opening 18. In one embodiment, the container 12 has a plurality of walls 15 that are substantially vertical and will be referred to as "vertical walls." Note that the integrated garbage can 10 may comprise any suitable rigid material, such as, for example, metal or plastic. In one embodiment, the walls 15 and the upper opening 18 are rounded such that the container 12 forms a generally oval shape, although the container 12 may have other shapes in other embodiments. A rim 19 is formed around the circumference of the opening 18 at an upper edge of the walls 15. The vertical walls 15 form a cavity 21 for receiving a garbage bag 20 to be used for holding trash. The garbage bag 20 may be secured within the container 12 by draping an upper portion of the bag 20 over the rim 19. In one embodiment, a portion of the floor 17 is elevated within the container 12. In this regard, the floor 17 is elevated relative to the surface on which the integrated garbage can 10 rests such that a garbage bag dispenser 23 may fit beneath the floor 17 at the base of the integrated garbage can 10. However, in other embodiments, the entire floor 17 may be elevated from the surface on which the integrated garbage can 10 rests such that only bottom edges of the walls 15 rest upon the surface.

The integrated garbage can 10 further comprises a drawer 25 for receiving the garbage bag dispenser 23. The drawer 25 may have a curved outer panel in order to align with the rounded surface of the wall 15. The dispenser 23 may comprise a box in which the disposable garbage bags 20 are sold or may comprise any other suitable container for dispensing the garbage bags 20. Upon receiving the dispenser 23, the drawer 25 may be inserted into a channel 27 at the base of the garbage can 10 in order to position the dispenser 23 beneath the floor 17. In one embodiment, the channel 27 is dimensioned such that the drawer 25 fits snugly within the channel 27 beneath the floor 17. The channel 27 may have grooves (not shown) or other means for guiding the drawer 25 within the channel 27. The floor 17 has an aperture 29 for receiving garbage bags 20 from the garbage bag dispenser 23. In one embodiment, shown in FIG. 1, the aperture 29 may be circular in shape. However, the aperture 29 may have other shapes in other embodiments. The aperture 29 is positioned such that, when the drawer 25 contains the dispenser 23 and is in the closed position, the garbage bags 20 extending from the dispenser 23 are aligned with the aperture 29. Thus, a new bag 20 may be pulled up through the floor 17 via the aperture 29 after a full bag 20 has been removed from the container 12. Once all of the bags 20 are removed from the dispenser 23, the drawer 25 may be opened and the dispenser 23 may be refilled with bags 20 or replaced with a full dispenser 23 in order to restock the integrated garbage can 10 with garbage bags 20.

Note that a lip 30 extends around the circumference of the opening 29. The lip 30 slopes down from the aperture 29 to a top surface of the floor 17 such that the aperture 29 is elevated slightly above the top surface of the floor 17. In this regard, if the garbage bag is filled with trash and is punctured, liquid contents of the bag which spill into the container 12 will be funneled away from the aperture 29 in order to prevent contamination of the bags 20 within the dispenser 23. Liquid contents may also seep through the garbage bag 20, and the raised lip 30 prevents such liquid contents from contaminating the bags 20 within the dispenser 23.

Furthermore, in one embodiment, the integrated garbage can 12 may be weighted such that the can 12 is not lifted when a full garbage bag 20 is removed from the container 12 or when a new garbage bag 20 is pulled through the aperture 29. The weight is preferably sufficient to overcome the upward force asserted on the can 12 by lifting of the bag 20, but the precise amount of weight may vary. However, in another embodiment, the garbage can 10 may have one or more nooks (not shown) for receiving a user's foot. Thus, when removal of the full garbage bag 20 is desirable, the user may insert his/her foot into the nook in order to exert a downward force on the can 10 which opposes the upward force from the bag 20 and to prevent the can 10 from lifting from the ground as the bag 20 is removed. Other means for preventing the can 10 from lifting from the ground are possible in other embodiments.

Figure 2:
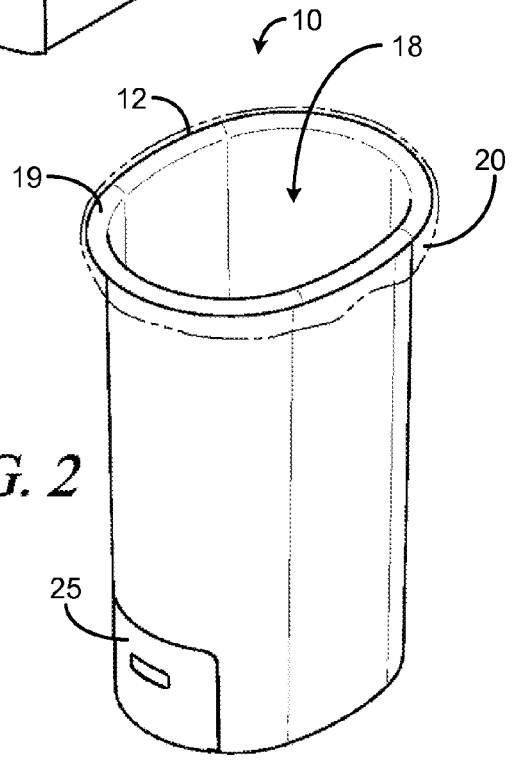
FIG. 2 is a top perspective view of the exemplary integrated garbage can and garbage bag dispenser of FIG. 1 with a garbage bag installed.

FIG. 2 depicts the exemplary integrated garbage can and garbage bag dispenser 10 with a bag 20 installed. As shown by FIG. 2, the drawer 25 is in the closed position. An end of the garbage bag 20 is draped over the rim 19 around the entire circumference of the opening 18, and the remainder of the bag 20 is positioned within the container 12. Thus, any trash that is placed in the opening 18 of the container 12 is captured by the bag 20 for easy removal and disposal, as is the case with conventional garbage cans. Furthermore, when removal of the bag 20 is desired, a user may lift the bag 20 vertically to remove the bag 20 from the container 12. As set forth above, in one embodiment, the integrated garbage can 10 is weighted in order to prevent the can 10 from lifting off of the ground or other surface when the bag 20 is removed from the container 12. However, in another embodiment, the can 10 may have at least one nook (not shown) for receiving a user's foot in order to provide resistance against the upward force of the bag 20 and to allow separation of the bag 20 from the can 10. Still other means for overcoming the upward force of the bag 20 are possible in other embodiments.

Note that, when the drawer 25 is in the closed position and the garbage bag 20 is installed in the integrated garbage can 10, the integrated garbage can 10 closely resembles a conventional garbage can. However, the integrated garbage can 10 avoids the drawbacks associated with conventional garbage cans.

Figure 3:
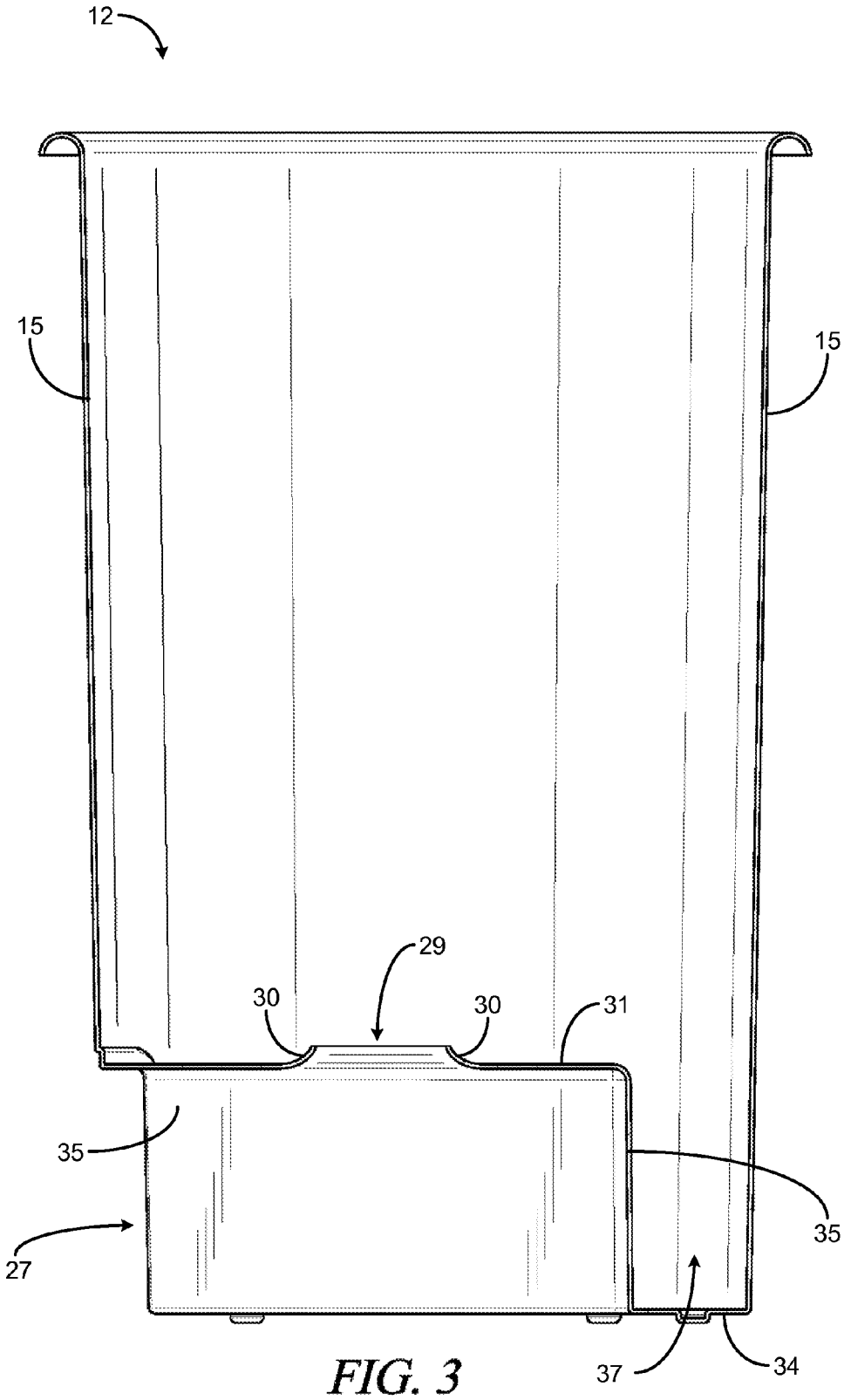
FIG. 3 is a side cutaway view of the container of FIG. 1 with the drawer and the garbage bag dispenser removed.

FIG. 3 depicts a side cutaway view of the container 12 of FIG. 1. As shown by FIG. 3, the container 12 has a generally horizontal floor 17. In one embodiment, as shown by FIG. 3, a portion 31 of the floor 17, referred to hereafter as the "elevated portion 31," is elevated with respect to the base of the container 12, although the entire floor 17 may be elevated in other embodiments. Furthermore, the elevated portion 31 may be different sizes and shapes in other embodiments. The elevated portion 31 extends from a wall 15 of the container 12 a given distance into the container 12. The floor 17 also has a portion 34 which is located at the base of the container 12 and is lower than the elevated portion 31, referred to hereafter as the "lower portion 34." The elevated portion 31 and the lower portion 34 are oriented in a generally horizontal direction and are coupled by one or more vertical interior walls 35. The lower portion 34, the walls 35, and an inner surface of the wall 15 of the container 12 form a trough 37 within the container 12.

A bottom surface of the elevated portion 31 and an outer surface of the walls 35 form a channel 27 which extends into the container 12 at a base of the wall 15. The channel 27 extends a given distance into the container 12 beneath the elevated portion 31 of the floor 17. The channel 27 is dimensioned such that the drawer 25 (FIG. 1) will fit within the channel 27 when the drawer 25 is in the closed position. The channel 27 depicted by FIG. 3 is generally rectangular in shape, although the channel 27 may have other shapes in other embodiments. Note that the channel 27 shown in FIG. 3 is bordered by the elevated portion 31 on top and by the vertical interior walls 35 on three sides. Thus, the bottom of the channel 27 and the front of the channel 27 beneath the wall 15 are open.

Furthermore, the floor 17 has the aperture 29 which extends vertically through the elevated portion 31 from the channel 27. The aperture 29 has the lip 30 encompassing the circumference of the aperture 29, and the lip 30 slopes downwardly away from the aperture 29 to an upper surface of the elevated portion 31 of the floor 17. Accordingly, any liquid contents which may spill or seep into the container 12 from the garbage bag 20 are funneled away from the aperture 29 and into the trough 37 thereby preventing contamination of the bags 20 positioned within the dispenser 23 (FIG. 1) beneath the elevated portion 17. The lip 30 and the trough 37 also help to prevent contamination of the surface upon which the container 12 rests if the drawer 25 is removed from the container 12. Note that, although the aperture 29 depicted by FIG. 3 is circular in shape, the aperture 29 may be different shapes in other embodiments, such as, for example, rectangular. In such embodiments, the lip 30 surrounds the entire perimeter of the aperture 29 and functions in the same way as when the aperture 29 is circular.

Figure 4:
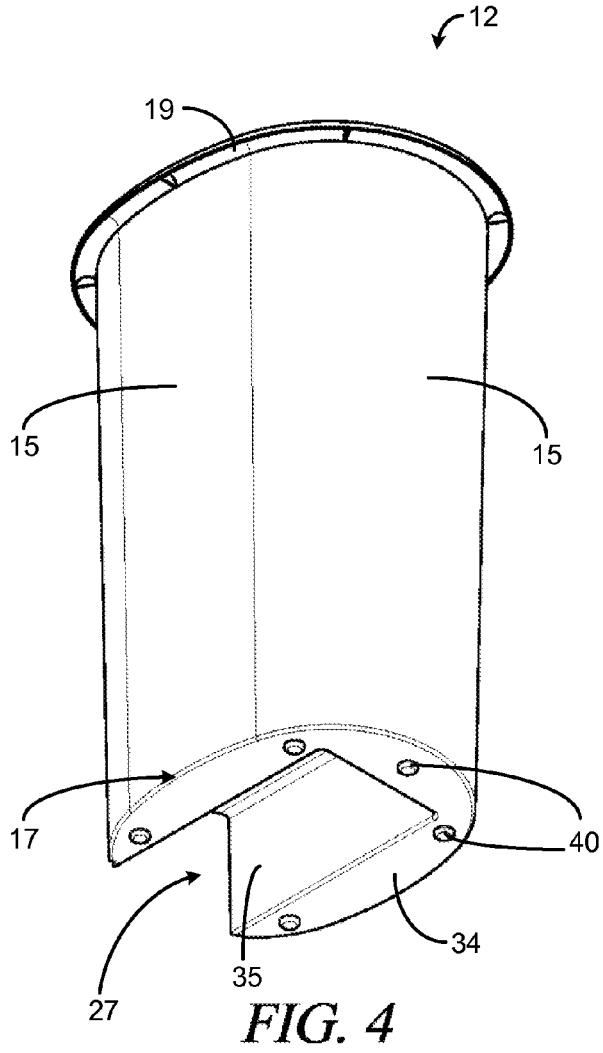
FIG. 4 is a bottom perspective view of the container of FIG. 1 with the drawer and the garbage bag dispenser removed.

FIG. 4 depicts a bottom perspective view of the container 12 of FIG. 1. The rim 19 extends past the walls 15 around the entire circumference of the opening 18 (FIG. 1). The rim 19 depicted by FIG. 4 is rounded, although the rim 19 may have different shapes in other embodiments. The channel 27 extends from a wall 15 and is formed by the vertical walls 35 and the bottom surface of the elevated portion 31 (FIG. 3) of the floor 17. The lower portion 34 of the floor 17 is generally u-shaped and is coupled to the bottoms of the walls 15 and the walls 35. Thus, the channel 27 and the lower portion 34 define the bottom of the container 12. In one embodiment, the channel 27 is generally rectangular in shape, although other shapes are possible in other embodiments depending on the orientation of the walls 15 and 35 and the lower portion 34.

The container 12 further comprises a plurality of supports 40 on the bottom surface of the lower portion 34 of the floor 17. In one embodiment, the supports 40 are formed as part of the lower portion 34 and comprise the same material as the container 12, such as, for example, plastic. However, in another embodiment, the supports 40 are attached to a lower surface of the lower portion 34 and comprise rubber, although other materials are possible. The supports 40 extend from the bottom surface of the lower portion 34 and support the weight of the container 12 in order to prevent the bottom surface of the lower portion 34 from resting directly on the floor, ground, or other surface on which the integrated garbage can 10 (FIG. 1) rests. In one embodiment, the supports 40 also grip to the floor, ground or other surface in order to prevent the garbage can 10 from sliding and scratching such surface. While five supports 40 are shown in FIG. 4, other numbers of supports 40 are possible in other embodiments.

Figure 5:
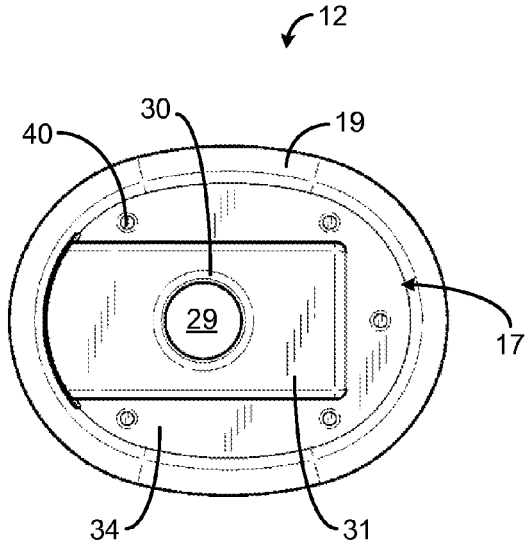
FIG. 5 is a top view of the container of FIG. 1 with the drawer and the garbage bag dispenser removed.

FIG. 5 depicts a top view of the container 12 of FIG. 1. As set forth above, in one embodiment, the container 12 is generally oval in shape, although other shapes are possible. The container 12 comprises the floor 17 having the elevated portion 31 and the lower portion 34. The elevated portion 31 extends from a wall 15 of the container 12 towards the opposing wall 15 and is surrounded on three sides by the lower portion 34. The elevated portion 31 may extend different distances and may comprise a different amount of the floor 17 in other embodiments. The difference in elevation between the elevated portion 31 and the lower portion 34 forms the trough 37 (FIG. 3) for capturing liquid which may leak from the bag 20 (FIG. 1).

The elevated portion 31 has the aperture 29 extending into the container 12 from the channel 27. The rim 30 encompasses the aperture 29 and slopes down to the elevated portion 31 away from the aperture 29. Thus, if liquid is spilled into the container 12, the liquid will not be funneled into the aperture 29 but will instead be directed away from the aperture 29 and into the trough 37. Accordingly, the bags 20 in the bag dispenser 23 (FIG. 1) which are positioned directly below the aperture 29 will likely remain uncontaminated by the spilled liquid. In one embodiment, shown by FIG. 5, the supports 40 are formed as part of the lower portion 34. However, in another embodiment, the supports 40 extend through the lower portion 34 and are held in place by screws (not shown) or other suitable attachment means.

Figure 6:
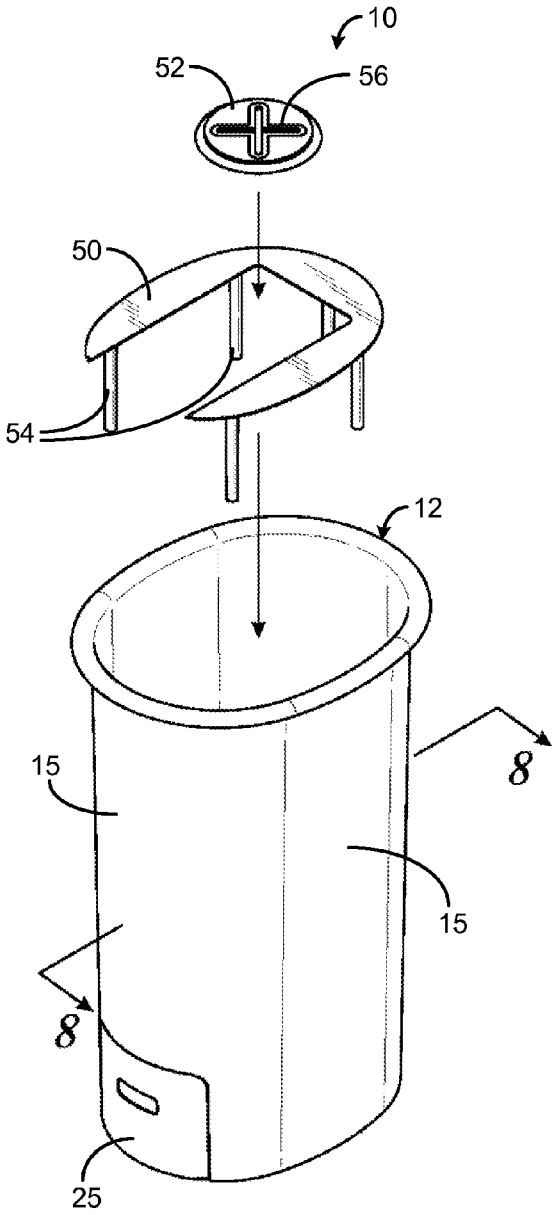
FIG. 6 is a top perspective view of the integrated garbage can and garbage bag dispenser of FIG. 1 with a false floor and a dispensing piece.

FIG. 6 depicts a top perspective view of the integrated garbage can and garbage bag dispenser 10 of FIG. 1 having a false floor 50 and a dispensing piece 52. The drawer 25 is in a closed position. As shown by FIG. 6, the integrated garbage can 10 further comprises the false floor 50 having a plurality of legs 54 extending from a lower surface of the false floor 50. The false floor 50 has the same dimensions as the lower portion 34 (FIG. 3) of the floor 17 (FIG. 1) in order to allow the false floor 50 to fit around the elevated portion 31 (FIG. 3) of the floor 17. While the false floor 50 shown in FIG. 6 is generally u-shaped, the false floor 50 may have different shapes in other embodiments depending on the dimensions of the elevated portion 31 and the lower portion 34. The legs 54 are approximately the same length as the vertical interior walls 35 (FIG. 3) in order position the false floor 50 on substantially the same plane as the elevated portion 31 of the floor 17. Thus, when the false floor 50 is installed within the container 12, the elevated portion 31 and the false floor 50 form a flat surface which fills the entire inner circumference of the container 12.

The integrated garbage can 10 further comprises the dispensing piece 52. The dispensing piece 52 is dimensioned to fit over the aperture 29 (FIG. 1). The dispensing piece 52 shown in FIG. 6 is circular, although other shapes are possible in other embodiments depending on the shape of the aperture 29. In one embodiment, the dispensing piece 52 has at least one slit 56 extending through the dispensing piece 52 for receiving garbage bags 20 (FIG. 1). Thus, when the dispensing piece 52 is positioned over the aperture 29, a garbage bag 20 may be pulled up through the slit 56 into the container 12. In one embodiment, the slit 56 is dimensioned such that only one garbage bag 20 will pass through the slit 56 at a time thereby allowing the user to quickly access the bag 20 for placement upon the container 12. In other embodiments, the dispensing piece 52 may have different means for dispensing garbage bags 20. Further, in the embodiment shown by FIG. 6, the slit 56 is in the shape of an "X," but other shapes are possible. As an example, the slit 56 may be circular.

When the dispensing piece 52 is positioned over the aperture 29, the dispensing piece 52 further protects the garbage bags 20 within the dispenser 23 from contamination by covering a majority of the aperture 29 and directing the spilled liquid or other trash away from the aperture 29. Furthermore, the false floor 50 may comprise a relatively dense material, such as, for example, steel or other metal or similar material, which may be inexpensive yet adds a sufficient amount of weight to the garbage can 10 in order to overcome the upward force applied to the garbage can 10 when the full garbage bag 20 is removed from the container 12 or when a new garbage bag 20 is pulled through the dispensing piece 52. Additional weight other than the weight of the false floor 50 may be added to the garbage can 10 in other embodiments.

Figure 7:
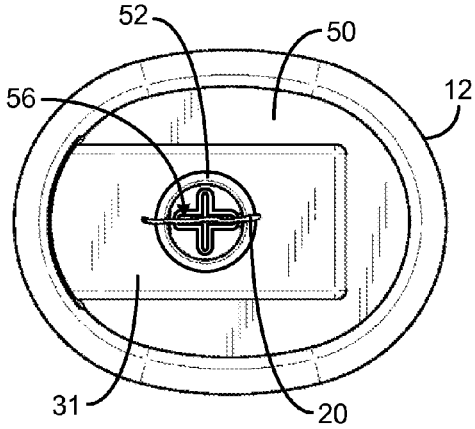
FIG. 7 is a top view of the integrated garbage can and garbage bag dispenser depicted in FIG. 6 with the false floor and the dispensing piece installed.

FIG. 7 depicts a top view of the integrated garbage can 10 of FIG. 6. The false floor 50 is positioned within the container 12 around the elevated portion 31, and the dispensing piece 52 is positioned over the aperture 29. The false floor 50 is in generally the same plane as the elevated portion 31 such that the false floor 50 and the elevated portion 31 form a substantially flat surface within the container 12. Thus, when a garbage bag 20 is installed in the container 12, a bottom surface of the garbage bag 20 rests on the flat surface until removal of the garbage bag 20 is desired.

Note that no garbage bag 20 is installed within the container 12 of FIG. 7, but a new garbage bag 20 is extending from the dispenser 23 (FIG. 1), through the aperture 29, and through the dispensing piece 52 into the container 12. When the garbage bag 20 is pulled upward into the container 12, the slit 56 of the dispensing piece 52 hugs opposing sides of the bag 20 in order to ensure that only one bag 20 is dispensed at a time. As set forth above, the weight of the false floor 50 opposes the upward force applied to the garbage can 10 when the bag 20 is dispensed in order to prevent the can 10 from lifting off of the surface on which it rests. However, in one embodiment, as set forth above, the container 12 may have one or more nooks (not shown) for receiving a user's foot thereby opposing the upward force of the bag 20.

Figure 8:
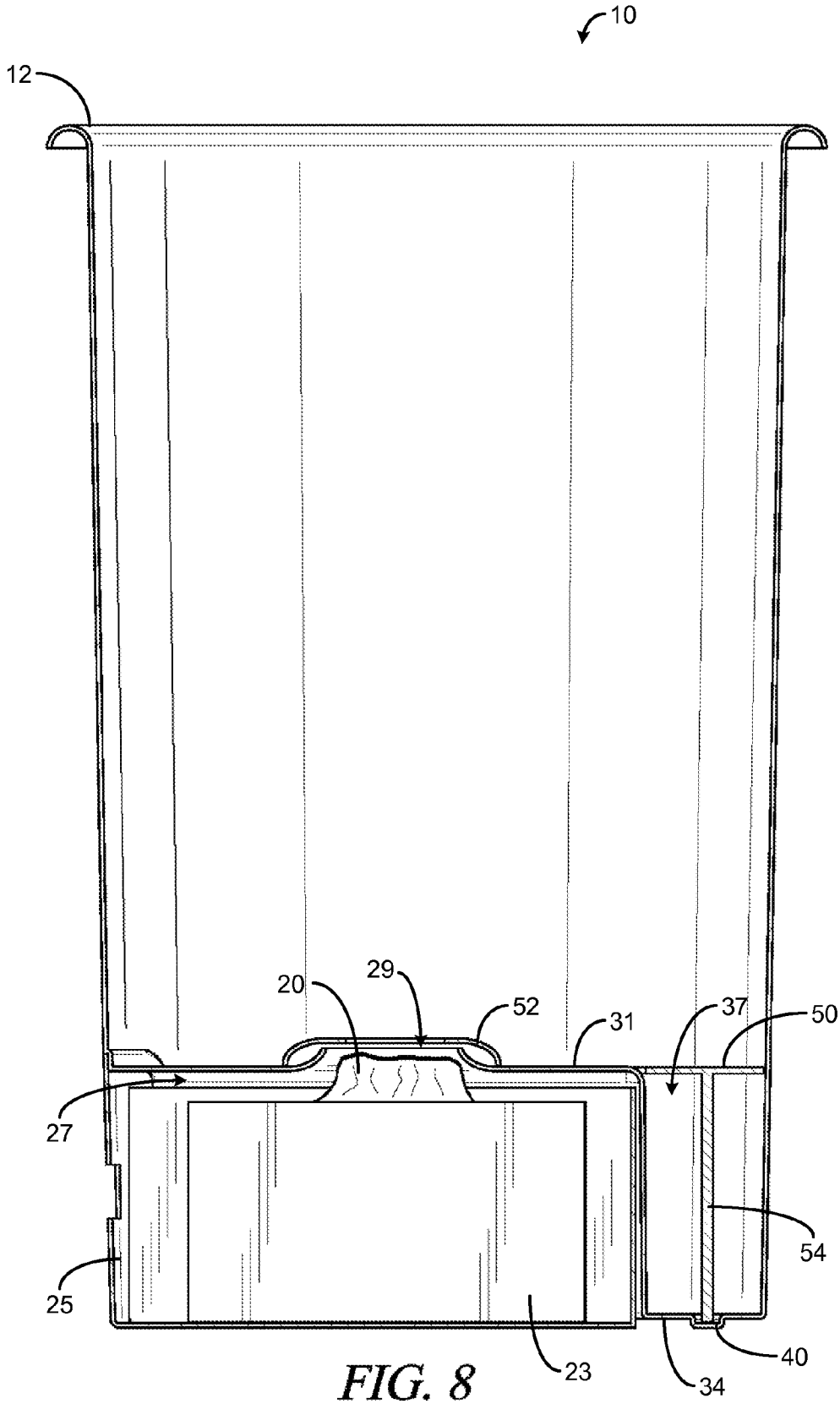
FIG. 8 is a side cutaway view of the integrated garbage can and garbage dispenser of FIG. 6 with the false floor and the dispensing piece installed.

FIG. 8 depicts a side cutaway view of the integrated garbage can and garbage bag dispenser 10 of FIG. 6. Note that, in FIG. 8, the false floor 50 is installed in the container 12 and the dispensing piece 52 is positioned over the aperture 29. Also note that the dispenser 23 is positioned within the drawer 25, the drawer 25 is in the closed position, and the bag 20 is extending from the dispenser 23 to the aperture 29 just below the dispensing piece 52. Thus, when the dispenser 23 is placed in the drawer 25 and the drawer 25 is in the closed position, the bags 20 extending from the dispenser 23 are vertically aligned with the aperture 29. Accordingly, when a new garbage bag 20 is desired, the user may reach through the dispensing piece 52 and pull the new garbage bag 20 through the aperture 29 and the dispensing piece 52 into the container 12 for installation in the container 12.

The false floor 50 is level with the elevated surface 31 and covers the entire trough 37. The legs 54 extend generally perpendicularly from a bottom surface of the false floor 50 and each leg 54 is positioned within the corresponding support 40 in order to secure the false floor 50 in place. Furthermore, the dispensing piece 52 assists in diverting spilled liquid from the aperture 29 into the trough 37 beneath the false floor 50. In one embodiment, placement of the false floor 50 around the elevated portion 31 creates a water-tight seal around the trough 37 which prevents liquid from entering the trough 37. In any event, any liquid or other trash which may enter the container 12 when no bag is installed or otherwise does not contaminate the bags 20 within the dispenser 23 but is maintained within the container 12.

In one exemplary embodiment, assume that the container 12 is generally oval in shape and comprises plastic. Also assume that the elevated portion 31 of the floor 17 extends from a wall 15 of the container 12, and the lower portion 34, the walls 35 and the walls 15 form a u-shaped trough 37 within the container 12. Further assume that the drawer 25 has a curved outer panel which aligns with the curved surface of the wall 15, and the dispenser 23 comprises a box in which the garbage bags 20 are packaged. Also assume that the opening 29 is circular and has the lip 30 extending around the circumference of the opening 29, and the dispensing piece 52 is circular. Finally assume that the false floor 50 is generally u-shaped and is sufficiently weighted to prevent the integrated garbage can 10 from lifting off of the surface when a garbage bag 20 is removed from the container 12 or the dispenser 23.

Figure 9:
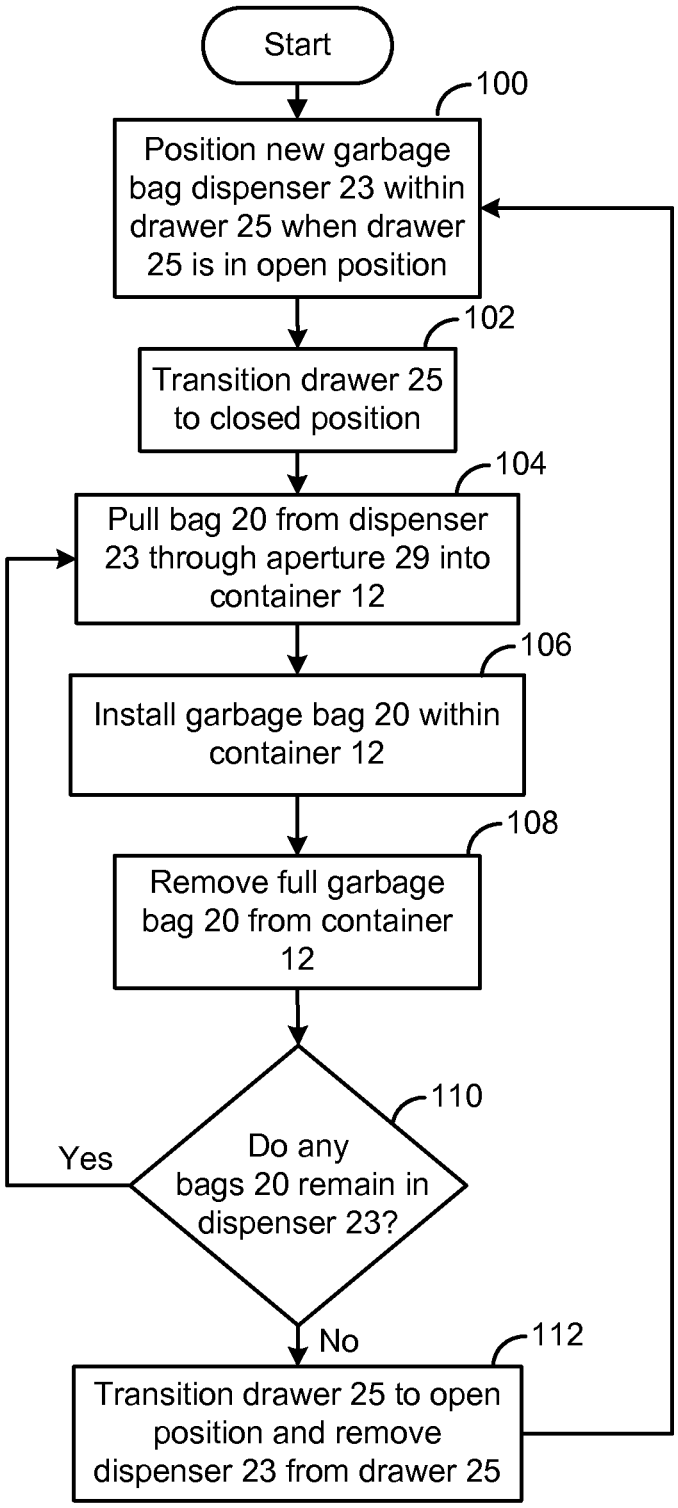
FIG. 9 is a flowchart depicting an exemplary method of using an integrated garbage can and garbage bag dispenser.

The garbage bag dispenser 23 having new garbage bags 20 is positioned within the drawer 25 when the drawer 25 is in an open position, as shown by block 100 of FIG. 9. A new garbage bag 20 extends partially from the dispenser 23 in a vertical direction. The drawer 25 is transitioned by hand to a closed position such that the new garbage bag 20 extending from the dispenser 23 is vertically aligned with the aperture 29 of the elevated portion 31 of the floor 17, as shown by block 102. When installation of the new garbage bag 20 in the container 12 is desired, the user reaches through the dispensing piece 52 and through the aperture 29 in order to grab the new garbage bag 20 and pull the bag 20 upward through the aperture 29 and the dispensing piece 52 into the container 12, as shown by block 104. The dispensing piece 52 ensures that only one bag 20 is pulled into the container 12 at a time. The user may then install the garbage bag 20 in the container 12 such that an upper portion of the garbage bag 20 drapes over the rim 19 of the container 12 around the entire circumference of the rim 19, as shown by block 106. Trash may then be placed or thrown into the garbage bag 20 while the bag 20 is installed in the container 12.

Now assume that the garbage bag 20 is completely filled with trash. Once the garbage bag 20 is filled with trash, the user removes the upper portion of the bag 20 from over the rim 19 and lifts the bag 20 from the container 12. The weight of the integrated garbage can 10 opposes the upward force placed on the inner surface of the container 12 by the garbage bag 20 such that the bag 20 is disengaged from within the container 12 without lifting the integrated garbage can 10 from the ground during removal, as shown by block 108. The bag 20 is easily removed from the container 12 and disposed of.

Now assume that the garbage bag 20 is ripped during removal and spills liquid contents into the container 12. The lip 30 extending around the aperture 29 directs the liquid away from the aperture 29 such that the liquid does not contaminate the new garbage bags 20 within the dispenser 23. Any liquid which spills directly onto the dispensing piece 52 is directed away from the aperture 29 by the dispensing piece 52. Accordingly, the liquid is captured in the trough 37 and stored until the user desires to dispose of the liquid.

Once the full garbage bag 20 is removed from the container 12, the user may check to see whether any new garbage bags 20 remain in the dispenser 23, as shown by block 110. If at least one new garbage bag 20 remains in the dispenser 23, the user may reach into the container 12 and pull a new garbage bag 20 up through the aperture 29 and the dispensing piece 52 into the container 12, as shown by block 104. The user may then install the garbage bag 20 in the container, as shown by block 106. Such process is repeated until no new garbage bags 20 remain in the dispenser 23.

Now assume that all of the new garbage bags 20 have been removed from the dispenser 23, as shown by block 110. The user transitions the drawer 25 by hand to the open position and removes the dispenser 23 from the drawer 25, as shown by block 112. The user then places a new dispenser 23 having new garbage bags 20 in the drawer 25 when the drawer 25 is in the open position, as shown by block 100. The user then transitions the drawer 25 to the closed position such that the new garbage bag 20 extending vertically from the dispenser 23 is vertically aligned with the opening 29, as shown by block 102. The user may then resume the process of removing the new garbage bags 20 from the dispenser 23 and installing the bags 20 in the container 12. Accordingly, an integrated garbage can and garbage bag dispenser 10 which avoids the drawbacks associated with conventional garbage cans is provided.

Now, therefore, the following is claimed:

1. An integrated garbage can and garbage bag dispenser, comprising:

a container having a plurality of exterior walls, an upper opening, and a floor, the floor having an elevated portion and a lower portion coupled by at least one interior wall, the elevated portion having an aperture extending therethrough, wherein the elevated portion comprises a lip extending around a circumference of the aperture, and wherein the lip slopes upward from an upper surface of the elevated portion;

a dispenser for storing a plurality of garbage bags; and a movable drawer for storing the dispenser, wherein the dispenser is positioned within the drawer, and wherein the drawer and the dispenser are inserted into a channel at a base of the container and are positioned beneath the elevated portion such that the garbage bags align with the aperture.

2. The integrated garbage can and garbage bag dispenser of claim 1, further comprising a plurality of supports positioned upon a bottom surface of the lower portion of the floor.

3. An integrated garbage can and garbage bag dispenser, comprising:

a container having a plurality of exterior walls, an upper opening, and a floor, the floor having an elevated portion and a lower portion coupled by at least one interior wall, the elevated portion having an aperture extending therethrough;

a dispenser for storing a plurality of garbage bags;

a movable drawer for storing the dispenser, and a dispensing piece positioned over the aperture within the container, the dispensing piece having a slit therethrough for allowing one of the garbage bags to pass through at a time, wherein the dispenser is positioned within the drawer, and wherein the drawer and the dispenser are inserted into a channel at a base of the container and are positioned beneath the elevated portion such that the garbage bags align with the aperture.

4. An integrated garbage can and garbage bag dispenser, comprising:

a container having a plurality of exterior walls, an upper opening, and a floor, the floor having an elevated portion and a lower portion coupled by at least one interior wall, the elevated portion having an aperture extending therethrough;

a dispenser for storing a plurality of garbage bags;

a movable drawer for storing the dispenser, and a false floor having a plurality of legs extending from a bottom surface of the false floor, wherein lower ends of the legs are positioned upon the lower portion of the floor and support the false floor such that the false floor is in substantially the same horizontal plane as the elevated portion of the floor, wherein the dispenser is positioned within the drawer, and wherein the drawer and the dispenser are inserted into a channel at a base of the container and are positioned beneath the elevated portion such that the garbage bags align with the aperture.

5. The integrated garbage can and garbage bag dispenser of claim 4, wherein the false floor comprises steel.

6. An integrated garbage can and garbage bag dispenser, comprising:

a container having an elevated floor and at least one exterior wall, the elevated floor and the at least one exterior wall forming a cavity for receiving a garbage bag, the elevated floor having an aperture, wherein the container has a channel extending from the aperture to an opening in the at least one exterior wall, and wherein the elevated floor has an elevated lip surrounding the aperture; and a dispenser for storing a plurality of garbage bags, the dispenser positioned within the channel such that the plurality of garbage bags are accessible through the aperture.

7. The integrated garbage can and garbage bag dispenser of claim 6, further comprising a movable drawer positioned in the channel, wherein the dispenser is positioned within the movable drawer.

8. The integrated garbage can and garbage bag dispenser of claim 6, wherein the container has a trough, and wherein the trough and the channel are separated by an interior wall of the container.

9. The integrated garbage can and garbage bag dispenser of claim 8, wherein the trough is between the interior wall and the at least one exterior wall.

10. The integrated garbage can and garbage bag dispenser of claim 6, wherein the container has a trough positioned such that liquid flows from the elevated lip across the elevated floor to the trough.

11. The integrated garbage can and garbage bag dispenser of claim 10, wherein the trough and the channel are separated by an inner wall of the container.

12. An integrated garbage can and garbage bag dispenser, comprising:

a container having an elevated floor and at least one exterior wall, the elevated floor and the at least one exterior wall forming a cavity for receiving a garbage bag, the elevated floor having an aperture, wherein the container has a channel extending from the aperture to an opening in the at least one exterior wall;

a dispenser for storing a plurality of garbage bags, the dispenser positioned within the channel such that the plurality of garbage bags are accessible through the aperture; and a cover positioned over the aperture.

13. The integrated garbage can and garbage bag dispenser of claim 12, wherein the cover has a slit for receiving one of the garbage bags.

14. The integrated garbage can and garbage bag dispenser of claim 13, wherein the slit is dimensioned such that the cover contacts the one garbage bag on opposing sides of the garbage bag as the garbage bag is pulled through the slit.

15. The integrated garbage can and garbage bag dispenser of claim 14, wherein the elevated floor has an elevated lip surrounding the aperture.

16. A method, comprising:

sliding a dispenser through a channel of container such that the dispenser is aligned with an aperture within an elevated floor of the container, the dispenser storing a plurality of garbage bags, wherein the channel extends from the aperture to an opening of an exterior wall of the container, and wherein the container has a cavity formed by the exterior wall;

pulling one of the garbage bags from the dispenser through the aperture;

securing the one garbage bag to a rim of the container while the one garbage bag is within the cavity; and positioning a cover over the aperture.

17. The method of claim 16, wherein the sliding comprises moving a drawer through the channel, wherein the dispenser is positioned within the drawer.

18. The method of claim 16, wherein the elevated floor has an elevated lip surrounding the aperture.

19. The method of claim 16, wherein the container has a trough, and wherein the trough and the channel are separated by an interior wall of the container.

20. The method of claim 16, wherein the cover has a slit, and wherein the pulling comprises pulling the one garbage bag through the slit.

21. The method of claim 20, wherein the slit is dimensioned such that the cover contacts the one garbage bag on opposing sides of the garbage bag as the garbage bag is pulled through the slit.

* * * * *